United States Patent [19]

Engle et al.

[11] 4,438,923

[45] Mar. 27, 1984

[54] SHOCK-ABSORBING BASKETBALL GOAL UNIT

[75] Inventors: Charles J. Engle, St. Louis County; Robert A. Boitano, St. Louis, both of Mo.

[73] Assignee: Gared Corporation, St. Louis, Mo.

[21] Appl. No.: 371,960

[22] Filed: Apr. 26, 1982

[51] Int. Cl.[3] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 4,151,989 | 5/1979 | Dittrich | 273/1.5 A |
| 4,194,734 | 3/1980 | Tyner | 273/1.5 R |
| 4,320,896 | 3/1982 | Engle et al. | 273/1.5 R |
| 4,348,022 | 9/1982 | O'Donnell | 273/1.5 R |
| 4,353,548 | 10/1982 | Mahoney | 273/1.5 R |
| 4,365,802 | 12/1982 | Ehrat | 273/1.5 R |

OTHER PUBLICATIONS

Advertising Circular for Slam Dunk Reflex Rim 3-1982.

Advertising Circular for Toss Back Inc., Basketball Equipment 3-1983.

*Primary Examiner*—Paul E. Shapiro

*Attorney, Agent, or Firm*—Kalish & Gilster

[57] ABSTRACT

A basketball goal unit for use with a basketball backboard including a rigid backboard mounting frame adapted to be securely mounted to said backboard and a goal mounting frame configured for cooperative interengagement with the backboard mounting frame. A goal is carried by the goal mounting frame and a pivot shaft interconnects the goal mounting frame with the backboard mounting frame to permit pivotal rocking movement of the goal and goal mounting frame about a transverse pivot axis in response to the goal being struck or slapped or hung from, as by a player during a "dunk" shot. A curved leaf spring provides resilient coupling between the goal mounting and backboard mounting frames to permit resilient movement of the goal about the pivot axis, and a double-acting shock absorber provides damped coupling between said goal mounting and backboard mounting frames during this pivotal rocking movement.

8 Claims, 6 Drawing Figures

FIG. 1
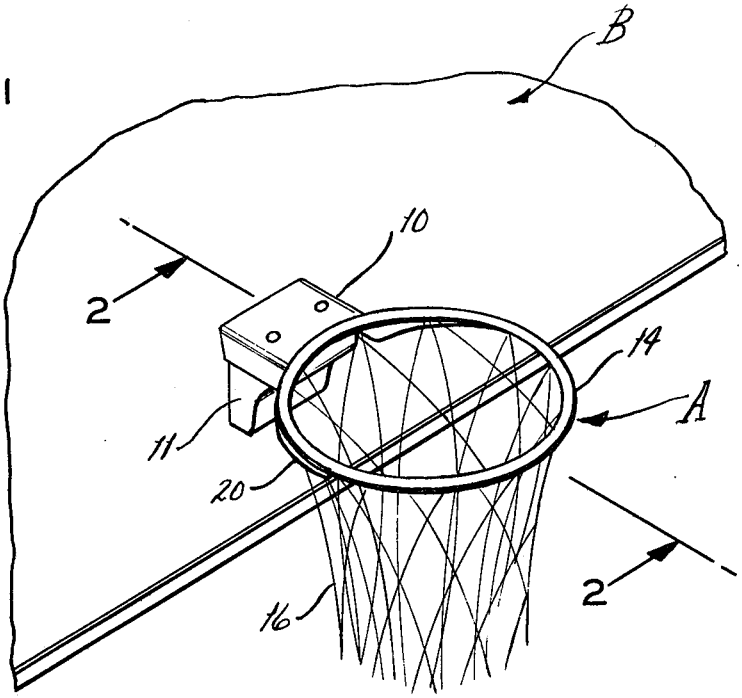
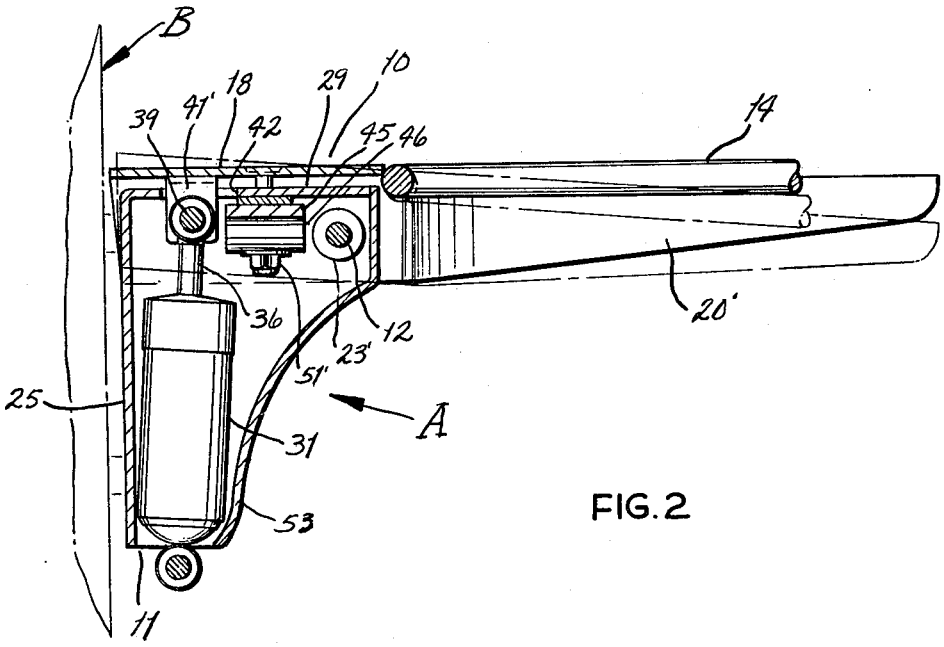
FIG. 2

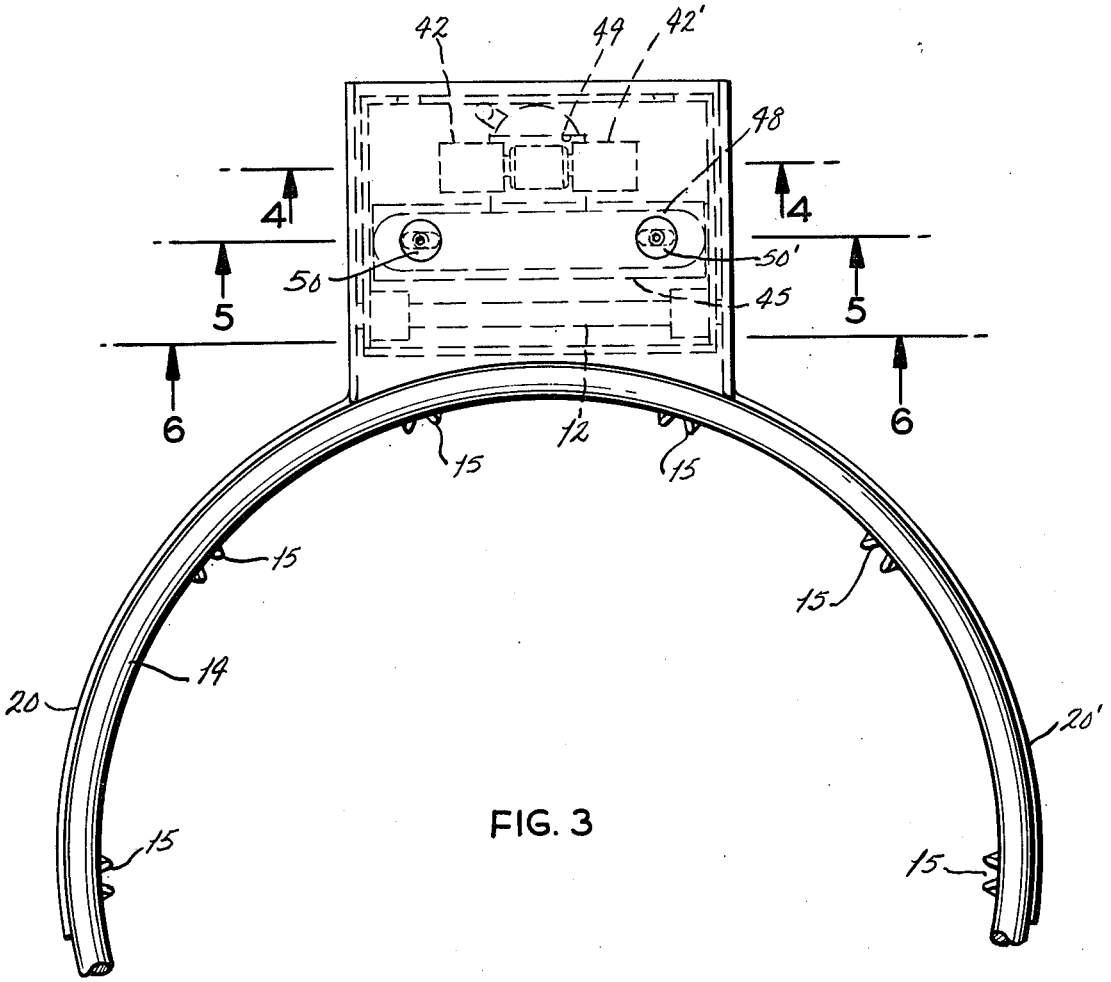
FIG. 3
FIG. 4
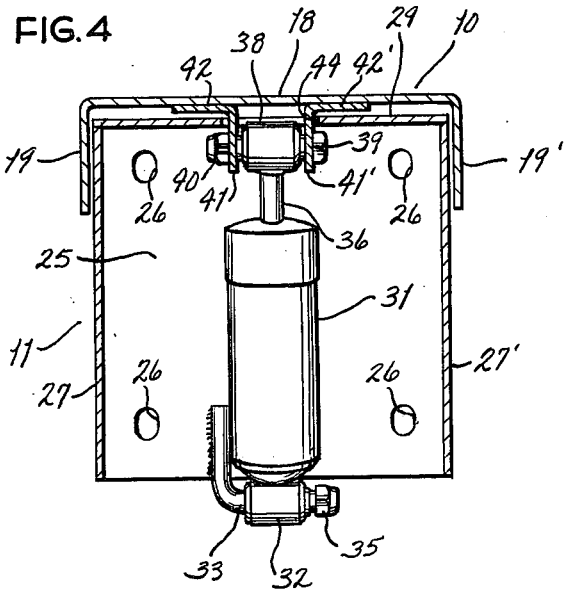
FIG. 5
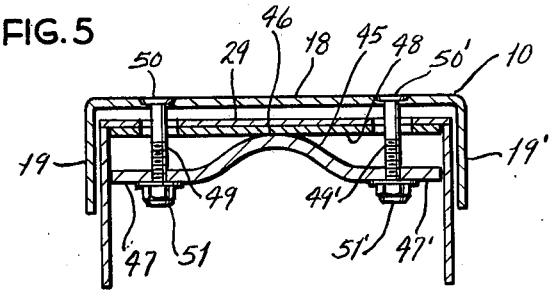
FIG. 6
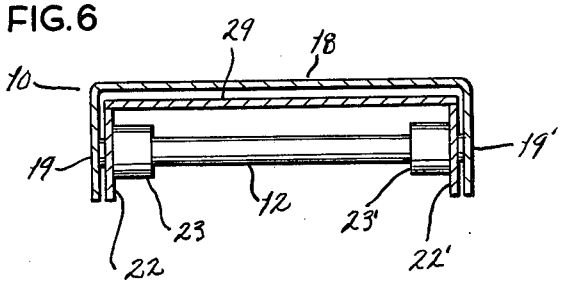

SHOCK-ABSORBING BASKETBALL GOAL UNIT

BACKGROUND AND SUMMARY OF THE INVENTION

This invention relates in general to basketball equipment and, more particularly, to a basketball goal unit of shock-absorbing capability for installation upon basketball backboards.

In recent years, the advent of glass backboards in professional, college and high school basketball has produced a peculiar problem in that the backboards are occasionally known to shatter in a most dramatic manner when the glass plate of the backboard is exposed to the force of a particular scoring shot referred to as a "slam dunk" or merely "dunk" shot whereby the player, having jumped a sufficient height, is enabled to drive the basketball downwardly through the basket from a point immediately thereabove. In the course of performing this particular shot, a player will most consistently effect a most forceful contact with the basket by either slapping, hitting, or pulling upon same with his hands, wrists, or arms. This last mentioned contact with substantial consistency tends to be so forceful that the backboard which is recognizedly of temper-plate glass is stressed beyond its elastic limits and thus completely shatters. A glass backboard, as of the type used in professional, college and high school, is of an area of 24 square feet so that the quantity of broken glass which is sprayed about constitutes a hazard of serious proportions; providing both a potential to injury to the players as well as the spectators who are nearby. In addition to the marked possibility of personal injury, such damage represents severe economic loss in view of the need for replacement and the necessary re-installation. Moreover, such damage can also cause a cessation of the particular game with a disruption as to the rights of the ticket holders.

Heretofore, very limited efforts have been made to try to render backboards resistant to dunk damage and the lack of success of such few efforts has caused the problem to remain unsolved yet being deprecated by players and on-lookers alike. Among such unsatisfying efforts are the structures set forth in the U.S. Letters Pat. Nos. 4,111,420 and 4,191,734. These patents while revealing shock absorbing means, as of cylindrical nature, disclose pivotal mountings for the basketball goal. Thus, the goal is mounted for forward rocking about a hinged axis parallel to the plane of the backboard so that the goal will rock downwardly under the force of the dunk shot. Similarly, the goal is mounted for rockable movement as about an axis perpendicular to the plane of the backboard so that the goal is thereby free to rock laterally. In addition, these patents provide structure so that the entire backboard would be free to rock. It can be appreciated that these structures are of such complex character that the same cannot be easily and economically adopted for usage. The use of the same would necessitate a replacement of all existing backboards and this would represent an economical loss of infinite proportions. Consequently, these structures have not been adopted as the utilization is not economically feasible.

Another effort to prevent the destruction of basketball backboards through performance of the dunk shot is shown in U.S. Pat. No. 4,151,989, but admittedly the basketball goal shown therein is intended solely for practice purposes as it is located at the end of a cantilever boom which has associated shock absorbing members in its zone proximate the supporting upright. But manifestly, this device is not even suggested as being amenable for game purposes and furthermore does not incorporate any element corresponding to a backboard.

A more sophisticated and effective arrangement for absorbing the stresses coupled to the backboard itself is evidenced by U.S. Letters Pat. No. 4,320,896 which is specifically intended for use only with glass backboards. However, this arrangement does not attempt to resiliently isolate the basketball goal itself from the backboard. Also, it provides an arrangement whose utility is essentially limited to glass backboards and is not readily adaptable for use with various existing backboards.

In recent years, there have been developed arrangements for providing a spring-like coupling between the basketball goal and the backboard. These arrangements typically employ coil springs. When the goal is struck by a player, there is, of course, resultant movement relative to the backboard permitted by the spring or springs. Yet, upon deflection, the goal is permitted to snap back with a violent shock producing action to its original position. Therefore, even though the springs are intended to prevent damage to the backboard, they nevertheless permit breakage in some conditions.

Therefore, it is an object of the present invention to provide an improved basketball goal unit of shock-absorbing character and which is readily usable with various types of backboards, whether such be metal, glass or synthetic.

Another object of the present invention is the provision of such a basketball goal unit which provides not only resilient but also shock-absorbing coupling between the basketball goal and the backboard whereby shock and damaging forces are effectively absorbed and damped before reaching the backboard to preclude their damaging transference between the goal and the backboard.

It is an object of the present invention to provide a shock absorbing basketball goal unit for a basketball backboard fabricated of shatterable material, such as glass, which may be easily and cheaply mounted upon existing backboards and which does not in any way alter the normal disposition of the basketball goal which is at all times rigidly presented in its customary, accepted manner.

It is a further object of the present invention to provide a shock absorbing basketball goal unit for use with basketball goals which uniquely protect a frangible backboard against the normal destructive forces applied through the exercising of the dunk shot without modifying the backboard or the goal in any manner as to cause the goal to be misplaced or to be displacable from its usual manner of presentation.

It is another object of the present invention to provide a shock absorbing basketball goal unit for basketball backboards which comprises a marked paucity of parts, all of which are of simple construction and of extreme durability so that replacement of any of such components is of marked unlikelihood.

It is a further object of the present invention to provide a shock absorbing basketball goal unit for basketball backboards which provides no element of interference with the usual playing of the game of basketball; the components of which unit may be most economically manufactured; which units are extremely reliable in usage; and which units may be installed upon existing backboards without the necessity of engaging highly skilled individuals.

BRIEF DESCRIPTION OF THE DRAWINGS

FIG. 1 is a perspective view of a basketball goal unit constructed in accordance with and embodying the present invention, as mounted upon a backboard.

FIG. 2 is a vertical cross-section taken generally along line 2—2 of FIG. 1.

FIG. 3 is a horizontal plan view of portions of the new basketball goal unit, and with certain elements thereof being shown in dashed line.

FIG. 4 is a fragmentary transverse vertical section taken generally along line 4—4 of FIG. 3.

FIG. 5 is a similar fragmentary transverse cross-section taken along line 5—5 of FIG. 4.

FIG. 6 is similarly a transverse cross-section of fragmentary character, as taken along line 6—6 of FIG. 4.

DESCRIPTION OF THE PREFERRED EMBODIMENT

Referring now by reference characters to the drawings which illustrate a preferred embodiment of a shock-absorbing basketball goal unit of the invention, A designates generally the goal unit itself, as mounted upon a backboard, generally B, which may be of any conventional type and shape, such as rectangular, fan-shaped, etc.

It will be understood that the background is not of any special type but rather may be any existing form of backboard to which it is desired to attach goal unit A. This includes backboards of glass, steel and synthetics.

Unit A comprises generally a goal mounting frame 10 configured for cooperative interengagement with a frame 11 which is adapted to be readily secured to backboard B and which thus may be referred to as a backboard mounting frame, these frames being pivotally interconnected by a shaft 12, as more fully explained below. Frame 10 carries a goal ring 14, as formed of round steel, and having fixed, as by welding, on its undersurface a plurality of circumferentially spaced net hooks 15 for the suspension of the usual basketball net 16.

Goal mounting frame 10 is of channel configuration being, as shown in FIGS. 4–6, of U-shaped cross section to provide a horizontal upper plate 18 and vertical side flanges 19, 19'. The side flanges extend forwardly toward a goal 14 to provide tapered elongated sections 20, 20' which extend partly around the circumference of goal ring 14 and which are secured, as by welding, to member 14 along the entire length of each of members 20, 20' to provide effective bracing of member 14 and thus resulting in a dimensionally stable, secure goal.

Extending between the side flanges 19, 19' is pivot shaft 12. Shaft 12 extends through corresponding flanges 22, 22' of mounting frame 11 and is spacedly maintained by enlarged diameter portions or sleeves 23, 23' which abut the inner face of flanges 22, 22'. Thus, frame 10 is free to rotate relative to frame 11 on the transverse pivot axis defined by shaft 12, while accurately locating frame 11 for precise movement relative to frame 10.

Frame 11 is of a configuration providing a vertical rear surface 25 of plate-like character having apertures at 26 to permit plate 25 to be bolted to the front face of backboard B, the apertures being of slotted character permitting angular adjustment of plate 25 for orienting the goal ring 14 in a precise horizontal configuration. Side flanges 27, 27' extend forwardly from plate 25 for stiffening and define the flanges 22, 22', at their upper extremities, through which shaft 12 extends. Frame 11 includes also a forwardly extending upper plate 29 underlying the upper plate 18 of frame 10. Thus, an arrangement is provided permitting frame 10 to rock about plate 12 and in this way allowing goal ring 14 to move downwardly from its normal horizontal orientation.

Interengaging the end of frame 10 adjacent backboard B and plate 25 of frame 11 is a shock-absorbing assembly including a two way shock absorber 31 having an eye 32 at its lower end fitted over a stud 33 provided by the horizontal portion of a rod-shaped member secured, as by welding, to the front face of plate 25. A self-locking nut 35 is threaded onto the end of stud 33. The actuator rod 36 of shock absorber 31 includes an eye 38 through which extends a bolt 39, also having a self-locking nut 40, which extends across two ears 41, 41' of flanges 42, 42' which are secured to the undersurface of plate 18, as by welding. A relatively large aperture 44 in plate 29 accommodates flanges 42, 42' and provides clearance for movement of these flanges relative to plate 29.

Because of its two-way capability, i.e., providing damping of movement of actuator rod 36 either upon elongation or contraction, shock absorber 31 will thus tend to damp the movement of goal ring 14 when moved either down or up. Thus, if during a "dunk" shot resulting in the player striking or hanging on the goal ring 14, it will be displaced downward but is damped during such movement while subsequently being damped when the ring returns to its normal position.

To provide a restorative force tending to maintain goal ring 14 in its horizontal position except when displaced by being struck, as by a player when making a goal, there is provided a spring 45 which is in the form of an elongated strip of tempered steel having an upwardly curved center portion or bight 46 and horizontal opposite end portions 47, 47'. Thus, spring 45 is configured in the shape of an inverted U of shallow character. The upturned bight 46 contacts strap 48 of configuration overlying the spring and bearing against the undersurface of plate 29. A pair of bolts 49, 49', having heads 50, 50' fitted into corresponding countersunk apertures in plate 18, extend through the opposite ends 47, 47' of the spring. Self-locking nuts 51, 51' bear against the lower surface of spring end portions 47, 47' and are tightened to pretension spring 45 so that its bight 46 bears against member 48 with a predetermined force which may, accordingly, be precisely established.

The components thus described are hidden by a cover 53 which extends downwardly across the front of frame 11.

Upon any movement of goal ring 14 downward by pivotal rocking upon shaft 12, the spring 45 will be additionally tensioned and, in this way, will provide resilient coupling between the goal mounting frame 10 and backboard mounting frame 11 which tends to bias the goal ring 14 for return to its normally horizontal position. The recurved configuration of the leaf spring provides a very high spring constant.

This arrangement is of an entirely novel character since it provides not only a resilient coupling between the basketball goal ring 14 of unit A and the basketball backboard B itself by providing a resilient coupling between the goal mounting and backboard mounting frames to permit resilient pivotal rocking of the goal ring 14 about its pivot axis, but also provides a shock absorbing coupling between the goal mounting and backboard mounting frames so that there will be effective damping of the movement of goal ring 14 when it is displaced from its normal position. Thus, during a "slam dunk" shot, the player who strikes the goal ring 14 or otherwise hangs from it, even momentarily, will cause displacement from the normal position, as resisted by spring 45, but with the movement being damped by extension of the shock absorber actuator rod 36 resulting from the lever arm on bolt 39 relative to the longitudinal axis of pivot shaft 12 produced by ring 14 as it is displaced. Upon release of the goal, shock absorber 31 absolutely prevents the ring from whipping back, with a reflex action, to its normal position, such as might cause loosening of the hardware or even breakage of a glass backboard. Instead, actuator rod 36 is damped in its movement by shock absorber 31 to produce a smooth, non-stressing movement of ring 14 to its original normal position.

Further, spring 45 can have its tension increased or decreased by the tightening or loosening, respectively, of nuts 51, 51' so that the resiliency or "bounce" of ring 14 can be changed if desired, as well as allowing more or less "give" to be established as may be desired for the type of use of goal unit A, whether for professional, collegiate, high school or still younger players. If spring 45 has its tension increased, the spring rate will be varied in view of the change in the geometry of spring 45 and with the appropriate amount of response being thus easily varied as may be desired. Such adjustment does not require the disassembly of the unit but rather can be easily effected by removing cover 53.

Since the backboard mounting frame 11 is predrilled for receiving bolts, all that is required for installation upon an existing backboard is the appropriate drilling of backboard B and rapid bolting to it of unit A, as an entity and without resort to time consuming assembly, securement of parts or tedious adjustment of same. Therefore, the present invention can be very quickly and cheaply installed on existing backboards by the usual handyman obviating the need for highly skilled technical artisans.

Because the new basketball A will provide resilient resistance to movement as well as bidirectional damping of to any movement of the goal such as may result from a player slapping, hitting or pulling upon the goal, this new unit is very advantageous for retrofit installation upon existing glass basketball backboards. When so utilized, goal unit A effectively diffuses and damps out the forces which are imparted to the goal ring 14 and prevents the shattering of the glass backboard with its attendant potential to injury of players and spectators not to mention the economic loss occasioned by damage to or destruction of this expensive and ever more common type of backboard.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A basketball goal unit for use with a basketball backboard having a front surface and comprising a rigid backboard mounting frame adapted to be securely mounted on the front surface of said backboard, including a first portion configured for lying against said backboard and for being secured thereto, and a second portion extending outwardly from said first portion, and, thereby, outwardly from the front surface of said backboard, a goal mounting frame configured for cooperative interengagement with said backboard mounting frame, said goal mounting frame being configured for overlying the second portion of said backboard mounting frame, a goal carried by said goal mounting frame, a pivot shaft for pivotally interconnecting said goal mounting frame with said backboard mounting frame to permit pivotal rocking movement of said goal and goal mounting frame about a transverse pivot axis, said pivot shaft connecting said goal mounting frame to said second portion of said backboard mounting frame, said goal mounting frame having a pivot shaft-remote portion extending from said pivot shaft toward said backboard, first coupling means for providing resilient coupling between said goal mounting and backboard mounting frames to permit resilient pivotal rocking movement of said goal about said pivot axis, and second coupling means for providing shock absorbing coupling between said goal mounting and backboard mounting frames during said pivotal rocking movement of said goal about said pivot axis, said first coupling means interconnecting said second portion of said backboard mounting frame and said pivot shaft-remote portion of said goal mounting frame, said second coupling means interconnecting said first portion of said backboard mounting frame and said pivot shaft-remote portion of said goal mounting frame, said pivot shaft-remote portion of said goal mounting frame and said second portion of said backboard mounting frame each being of channel section and of inverted-U configuration and each thereby having side flanges, said pivot shaft extending through said side flanges, said goal mounting frame thereby being pivotally secured to permit rocking movement of said goal about said pivot axis relative to said backboard upon said goal being displaced downwardly by external application of force, said first coupling means comprising a spring interengaging said second portion of said backboard mounting frame and said pivot shaft-remote portion of said goal mounting frame.

2. A basketball goal unit according to claim 1 and further characterized by said spring comprising an elongated length of strip material having a central portion, and opposite end portions extending laterally outwardly from said central portion, said central portion engaging the second portion of said backboard mounting frame, said opposite end portions of said spring being interconnected with the shaft-remote portion of said goal mounting frame.

3. A basketball goal unit according to claim 2 and further characterized by said spring resiliently biasing said pivot shaft-remote portion of said goal mounting frame toward the said second portion of said backboard mounting frame, and means adjustably connecting said opposite ends of said spring to said shaft-remote portion of said goal mounting frame, whereby said spring may be pretensioned.

4. A basketball goal unit according to claim 3 and further characterized by said spring being in the form of an elongated strip of tempered steel and said center portion being an upwardly curved bight providing said spring with the configuration of an inverted-U of shallow character, said bight being located for bearing against the under surface of said second portion of said backboard mounting frame.

5. A basketball goal unit according to claim 1 and further characterized by said second coupling means comprising a double acting shock absorber having opposite ends movable toward or away from each other by contraction or elongation of said shock absorber, said shock absorber providing damping for both contraction and elongation, said first portion of said backboard mounting frame and said shaft-remote portion of said goal mounting frame each including means for securement of a respective end for said shock absorber.

6. A basketball goal unit according to claim 5 and further characterized by a cover enclosing portions of said backboard mounting frame and for enclosing said shock absorber.

7. A basketball goal unit according to claim 1, said first and second coupling means being located within corresponding side flanges of said goal mounting and said backboard mounting frames.

8. A basketball goal unit according to claim 1 and further characterized by a cover enclosing portions of said backboard mounting frame for concealment of said first and second coupling means.

* * * * *

UNITED STATES PATENT OFFICE

CERTIFICATE OF CORRECTION

Patent No. 4,438,923 Dated March 27, 1984

Inventor(s) Charles J. Engle and Robert A. Boitano

It is certified that error appears in the above-identified patent and that said Letters Patent are hereby corrected as shown below:

In the Heading, after "Assignee", "Gared Corporation" should be ---Gared Company---.

Signed and Sealed this

*Fourteenth* Day of *August 1984*

[SEAL]

*Attest:*

GERALD J. MOSSINGHOFF

*Attesting Officer*

*Commissioner of Patents and Trademarks*